US008151982B2

(12) United States Patent
Still

(10) Patent No.: US 8,151,982 B2
(45) Date of Patent: Apr. 10, 2012

(54) PROTECTIVE COVERINGS AND METHODS OF MAKING AND USING THE SAME

(76) Inventor: Russell F. Still, Cumming, GA (US)

( * ) Notice: Subject to any disclaimer, the term of this patent is extended or adjusted under 35 U.S.C. 154(b) by 0 days.

(21) Appl. No.: 13/076,751

(22) Filed: Mar. 31, 2011

(65) Prior Publication Data

US 2011/0266176 A1 Nov. 3, 2011

Related U.S. Application Data

(60) Provisional application No. 61/330,176, filed on Apr. 30, 2010.

(51) Int. Cl.
*B65D 5/52* (2006.01)

(52) U.S. Cl. ..... 206/45.23; 206/45.24; 206/320; 206/576

(58) Field of Classification Search ..... 206/45.2, 206/45.23, 45.24, 320, 576, 762, 774, 45.28
See application file for complete search history.

(56) References Cited

U.S. PATENT DOCUMENTS

| | | | | | |
|---|---|---|---|---|---|
| 2,131,093 | A * | 9/1938 | Cage | 206/45.23 |
| 3,913,711 | A * | 10/1975 | Schmid | 206/45.23 |
| 4,070,489 | A * | 1/1978 | Pahnke | 206/45.2 |
| 4,708,239 | A * | 11/1987 | Bourbon | 206/45.23 |
| 4,972,943 | A * | 11/1990 | Fludd | 206/45.24 |
| 5,046,739 | A | 9/1991 | Reichow | |
| 5,188,223 | A * | 2/1993 | Brose et al. | 206/45.24 |
| 5,501,458 | A | 3/1996 | Mallory | |
| D432,586 | S | 10/2000 | Galli-Zugaro et al. | |
| D434,811 | S | 12/2000 | Aleman | |
| 6,241,247 | B1 | 6/2001 | Sternberg et al. | |
| 6,561,349 | B2 * | 5/2003 | Lee | 206/320 |
| 6,932,341 | B1 | 8/2005 | Kenyon | |
| 7,046,508 | B2 | 5/2006 | Lin | |
| D555,667 | S | 11/2007 | Hussaini et al. | |
| 7,637,376 | B2 * | 12/2009 | Silva et al. | 206/45.24 |
| D624,601 | S | 9/2010 | Grossman | |
| D632,341 | S | 2/2011 | Lim et al. | |
| D632,742 | S | 2/2011 | Mueller | |
| D632,743 | S | 2/2011 | Mueller | |

* cited by examiner

*Primary Examiner* — Luan K Bui
(74) *Attorney, Agent, or Firm* — Withers & Keys, LLC

(57) ABSTRACT

Protective coverings suitable for protecting and housing electronic devices such as a KINDLE™ ebook reader or an APPLE™ iPAD™ tablet are disclosed. Methods of making and using protective coverings are also disclosed.

19 Claims, 13 Drawing Sheets

PROTECTIVE COVERINGS AND METHODS OF MAKING AND USING THE SAME

CROSS-REFERENCE TO RELATED APPLICATIONS

This patent application claims the benefit of priority to U.S. Provisional Patent Application Ser. No. 61/330,176 filed on Apr. 30, 2010, the subject matter of which is hereby incorporated by reference in its entirety.

FIELD OF THE INVENTION

The present invention relates generally to protective coverings suitable for protecting and housing electronic devices such as a KINDLE™ ebook reader or an APPLE™ iPad™ tablet computer. The present invention further relates to methods of making and using protective coverings suitable for protecting and housing electronic devices.

BACKGROUND OF THE INVENTION

Numerous products exist that act as a stand and/or a carrying case for a class of flat electronic/computer devices such as a KINDLE™ ebook reader or an APPLE™ iPad™ tablet computer. However, known devices lack one or more desirable features. For example, known devices typically allow only a narrow range of positioning configurations in three-dimensional space for the electronic device they support. Because of this, a person using such a product will be limited to the number of body positions he/she may comfortably assume while using known devices.

SUMMARY OF THE INVENTION

The present invention provides a protective device that allows for a virtually limitless number of spatial placements of the electronic device it holds. Thus, a person may finely adjust the protective device of the present invention so that it holds an electronic device at an optimal position both horizontally and vertically while still allowing a third adjustment to place the electronic device's reading surface perpendicular to a user's line of sight. These types of adjustments can either not be made with known devices, or can only be made in very limited fashion, suitable only to a single body position by a user. These adjustments of the protective device of the present invention, however, allow optimal placement of an electronic device for a user, whether he or she is sitting, slouching, partially reclined, or fully reclined.

The present invention is directed to protective devices (also referred to herein as "protective coverings"). In one exemplary embodiment of the present invention, the protective device of the present invention comprises three basic parts: a base component referred to herein as "the housing," a retractable stand referred to herein as "the fold-out prop," and a flat surface referred to herein as "the lid" or "the lid component," which is used to both hold an electronic device in place, as well as to close the protective device of the present invention. The three component parts may be attached via two articulations so that they move independently of one another.

In another exemplary embodiment of the present invention, the protective covering comprises a protective covering for protecting and housing an electronic device, wherein the protective covering comprises (I) a housing component comprising a lower housing layer comprising a rear housing surface and an inner housing surface opposite the rear housing surface, at least one housing side wall extending upward from the lower housing layer and comprising an outer housing side wall surface and an inner housing side wall surface opposite the outer housing side wall surface, and at least one housing connection member along the inner housing side wall surface; and (II) a lid component comprising an upper lid layer comprising an upper lid surface, an inner lid surface opposite the upper lid surface, a connected lid end, and a moveable lid end opposite the connected lid end, and at least one lid side wall extending from the upper lid layer and comprising an outer lid side wall surface, an inner lid side wall surface opposite the outer lid side wall surface, and a lid side wall portion that extends over and is spaced from the inner lid surface; wherein the lid component is connected to the housing component along the connected lid end so that the moveable lid end is operatively adapted to move from a first closed position, wherein the inner lid surface extends over the inner housing surface, to a second open position, wherein substantially all of the inner lid surface does not extend over the inner housing surface.

In yet another exemplary embodiment of the present invention, the protective covering comprises a protective covering for protecting and housing an electronic device, wherein the protective covering comprises (I) a housing component comprising a lower housing layer comprising a rear housing surface and an inner housing surface opposite the rear housing surface, at least one housing side wall extending upward from the lower housing layer and comprising an outer housing side wall surface and an inner housing side wall surface opposite the outer housing side wall surface, and at least one housing connection member along the inner housing side wall surface; (II) a lid component comprising an upper lid layer comprising an upper lid surface, an inner lid surface opposite the upper lid surface, a connected lid end, and a moveable lid end opposite the connected lid end, and at least one lid side wall extending from the upper lid layer and comprising an outer lid side wall surface, an inner lid side wall surface opposite the outer lid side wall surface, and a lid side wall portion that extends over and is spaced from the inner lid surface; and (III) a fold-out prop member comprising a connected fold-out prop member end, and a moveable fold-out prop member end opposite the connected fold-out prop member end, the connected fold-out prop member end being connected to the rear housing surface so that the moveable fold-out prop member end is operatively adapted to move from a first parallel position, wherein the moveable fold-out prop member end extends along and is proximate to the rear housing surface, to a second angled position, wherein the moveable fold-out prop member end is positioned away from the rear housing surface; the lid component being connected to the housing component along the connected lid end so that the moveable lid end is operatively adapted to move from a first closed position, wherein the inner lid surface extends over the inner housing surface, to a second open position, wherein substantially all of the inner lid surface does not extend over the inner housing surface; wherein the housing component further comprises a recessed groove extending along the rear housing surface, and the fold-out prop member is sized so as to fit within the recessed groove when the fold-out prop member is in the first parallel position.

In yet a further exemplary embodiment of the present invention, the protective covering comprises a protective covering for protecting and housing an electronic device, wherein the protective covering comprises (I) a housing component comprising a lower housing layer comprising a rear housing surface and an inner housing surface opposite the rear housing surface, at least one housing side wall extending upward from the lower housing layer and comprising an outer housing side wall surface and an inner housing side wall surface opposite the outer housing side wall surface, and at least one housing connection member along the inner housing side wall surface; (II) a lid component comprising an upper lid layer comprising an upper lid surface, an inner lid surface opposite the upper lid surface, a connected lid end, and a moveable lid end opposite the connected lid end, a first lid side wall extending from the upper lid layer proximate the moveable lid end, and a second lid side wall extending from the upper lid layer proximate the connected lid end, each of the first and second lid side walls comprising a lid side wall portion that extends over and is spaced from the inner lid surface, the first and second lid side walls being spaced from one another so as to accommodate an electronic device positioned between the first and second lid side walls; and (III) a fold-out prop member comprising a connected fold-out prop member end, and a moveable fold-out prop member end opposite the connected fold-out prop member end, the connected fold-out prop member end being connected to the rear housing surface so that the moveable fold-out prop member end is operatively adapted to move from a first parallel position, wherein the moveable fold-out prop member end extends along and is proximate to the rear housing surface, to a second angled position, wherein the moveable fold-out prop member end is positioned away from the rear housing surface; the lid component being connected to the housing component along the connected lid end so that the moveable lid end is operatively adapted to move from a first closed position, wherein the inner lid surface extends over the inner housing surface, to a second open position, wherein substantially all of the inner lid surface does not extend over the inner housing surface; wherein the housing component further comprises a recessed groove extending along the rear housing surface, and the fold-out prop member is sized so as to fit within the recessed groove when the fold-out prop member is in the first parallel position.

The present invention is also directed to methods of making protective coverings. In one exemplary embodiment of the present invention, the method of making a protective covering comprises the step of forming at least one molded part comprising (i) the housing component, (ii) the fold-out prop member, and (iii) the lid component; and connecting (i) the housing component, (ii) the fold-out prop member, and (iii) the lid component. The method of making a protective covering may further comprise one or more additional steps including, but not limited to, printing and/or adhering an image onto an outer surface of the at least one molded part; and packaging the protective covering.

The present invention is further directed to methods of using a protective covering to protect and house an electronic device. In one exemplary embodiment of the present invention, the method of using a protective covering comprises a method of covering an electronic device, wherein the method comprises positioning the electronic device along an inner surface of the lid component; and closing the protective covering so as to protect and house the electronic device within the housing component.

In another exemplary embodiment, the method of using a protective covering comprises opening a protective covering having an electronic device positioned therein; withdrawing a fold-out prop member from a first position adjacent a lower surface of the housing component; and adjusting a height of the electronic device by adjusting (i) a position of the fold-out prop member relative to the housing component, (ii) a position of the lid component relative to the housing component, or (iii) both (i) and (ii).

These and other features and advantages of the present invention will become apparent after a review of the following detailed description of the disclosed embodiments and the appended claims.

BRIEF DESCRIPTION OF THE FIGURES

The present invention is further described with reference to the appended figures, wherein.

DETAILED DESCRIPTION OF THE INVENTION

The present invention is directed to protective coverings suitable for protecting and housing electronic devices such as a KINDLE™ ebook reader or an APPLE™ iPAD™ tablet. The present invention is further directed to methods of making, as well as methods of using protective coverings suitable for protecting and housing electronic devices.

The protective coverings of the present invention may comprise a number of components. A description of individual components and combinations of individual components is provided below.

I. Device Components

The protective coverings of the present invention may comprise one or more of the following components.

A. Housing Component

Figure 1:
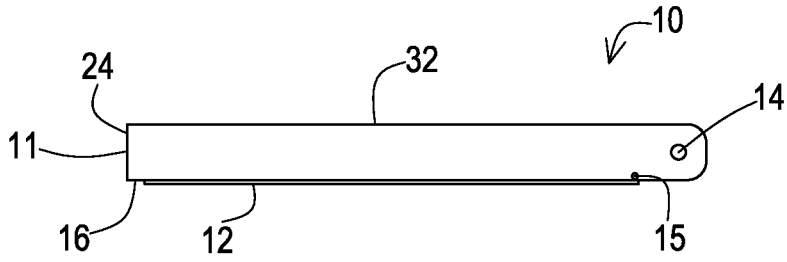
FIG. 1 depicts a side view of an exemplary protective covering of the present invention.
Figure 2:
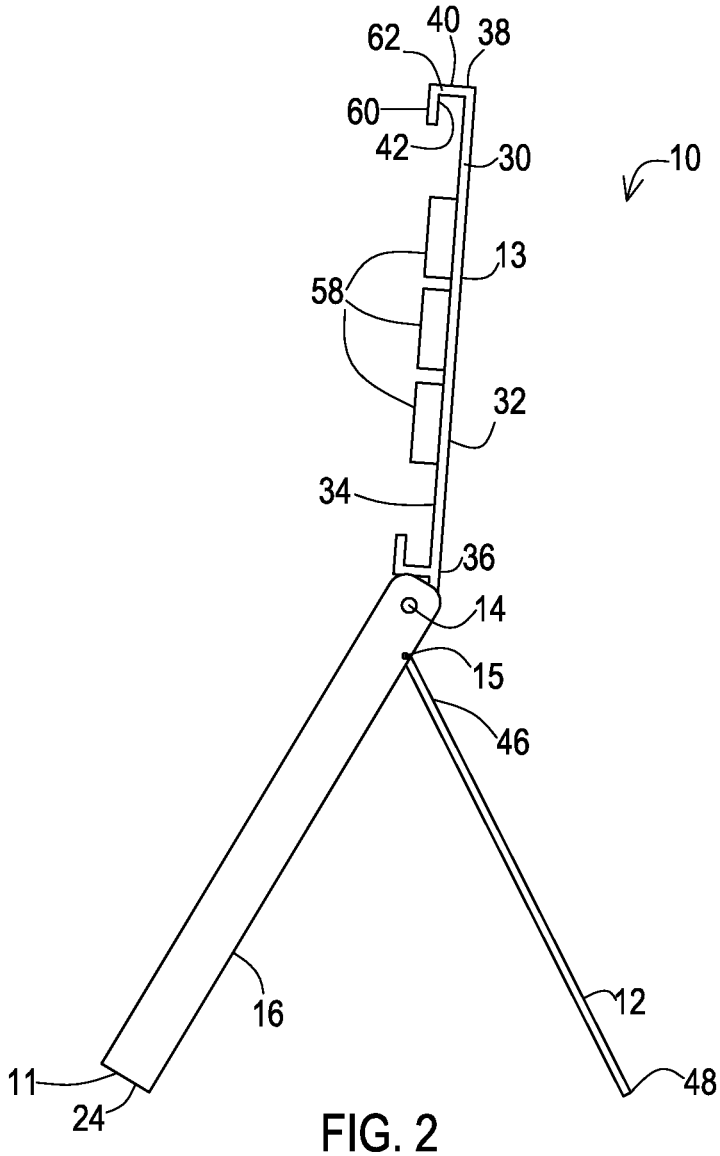
FIG. 2 depicts a side view of the exemplary protective covering shown in FIG. 1 in an opened and tilted configuration.
Figure 3:
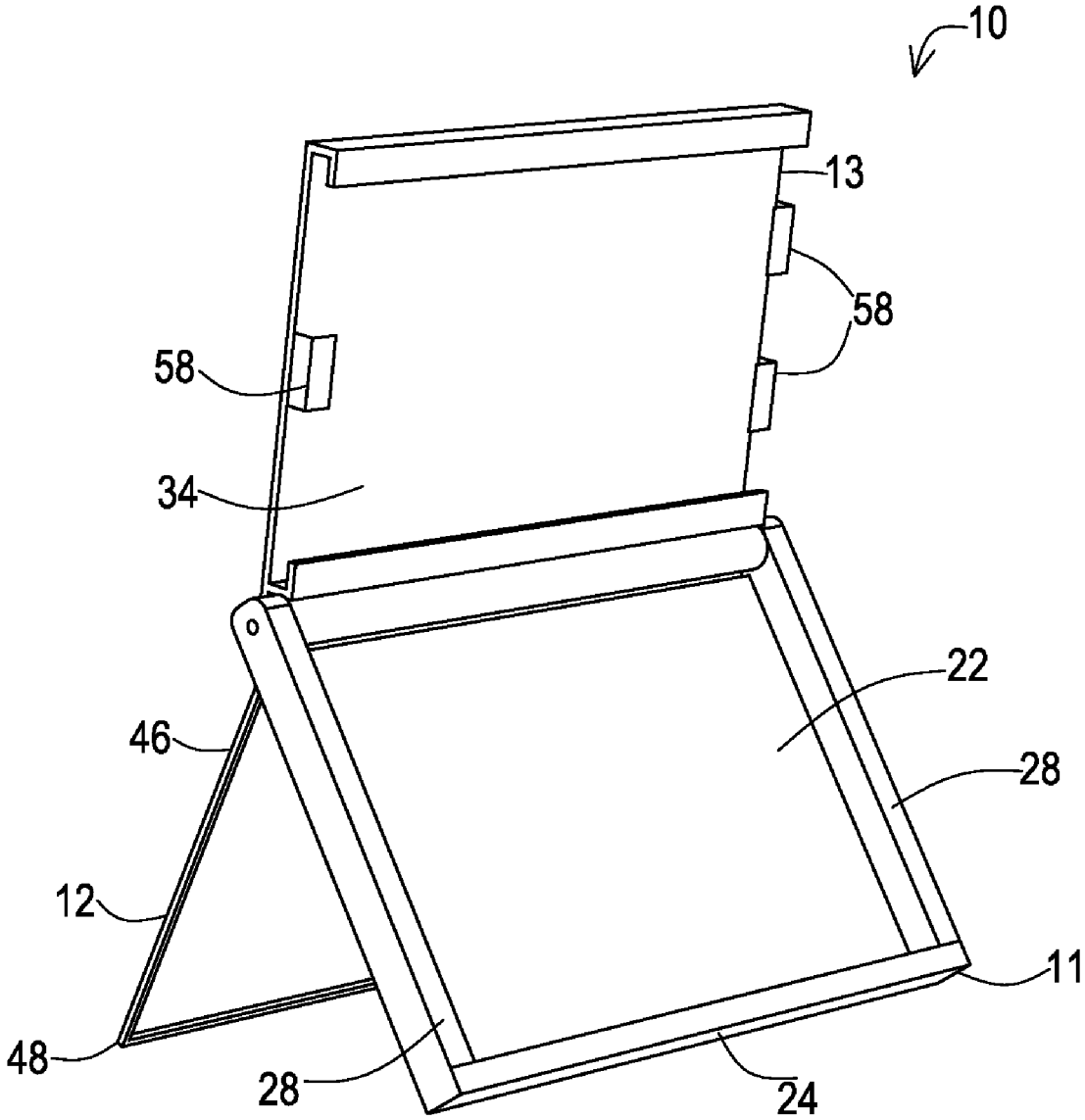
FIG. 3 depicts a perspective view of the exemplary protective covering shown in FIG. 1 in an opened and tilted configuration.
Figure 4:
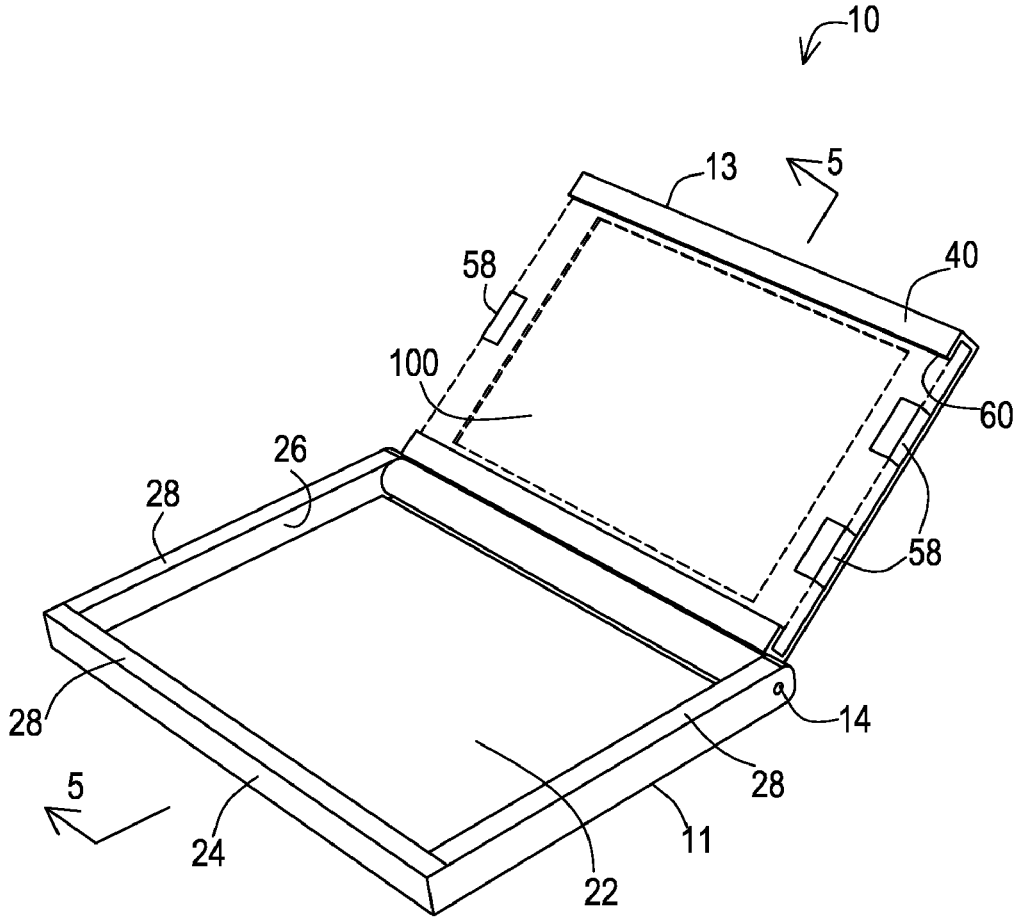
FIG. 4 depicts a perspective view of the exemplary protective covering shown in FIG. 1 in an opened configuration and housing an exemplary electronic device.
Figure 5:
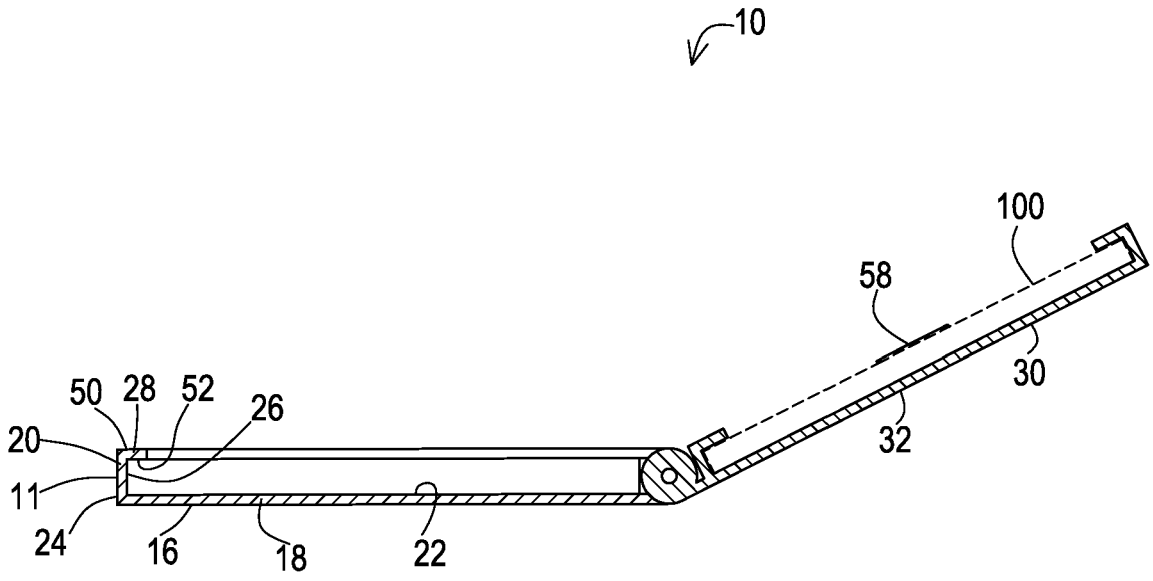
FIG. 5 depicts a cross-sectional view of the exemplary protective covering shown in FIG. 4 as viewed along line A-A.

The protective coverings of the present invention comprise a housing component such as exemplary housing component 11 shown in FIG. 1. As shown in FIGS. 1-5, exemplary housing component 11 comprises a lower housing layer 18 comprising a rear housing surface 16 and an inner housing surface 22 opposite rear housing surface 16; at least one housing side wall 20 extending upward from lower housing layer 18 and comprising an outer housing side wall surface 24 and an inner housing side wall surface 26 opposite outer housing side wall surface 24, and at least one housing connection member 14 along inner housing side wall surface 26.

Figure 7:
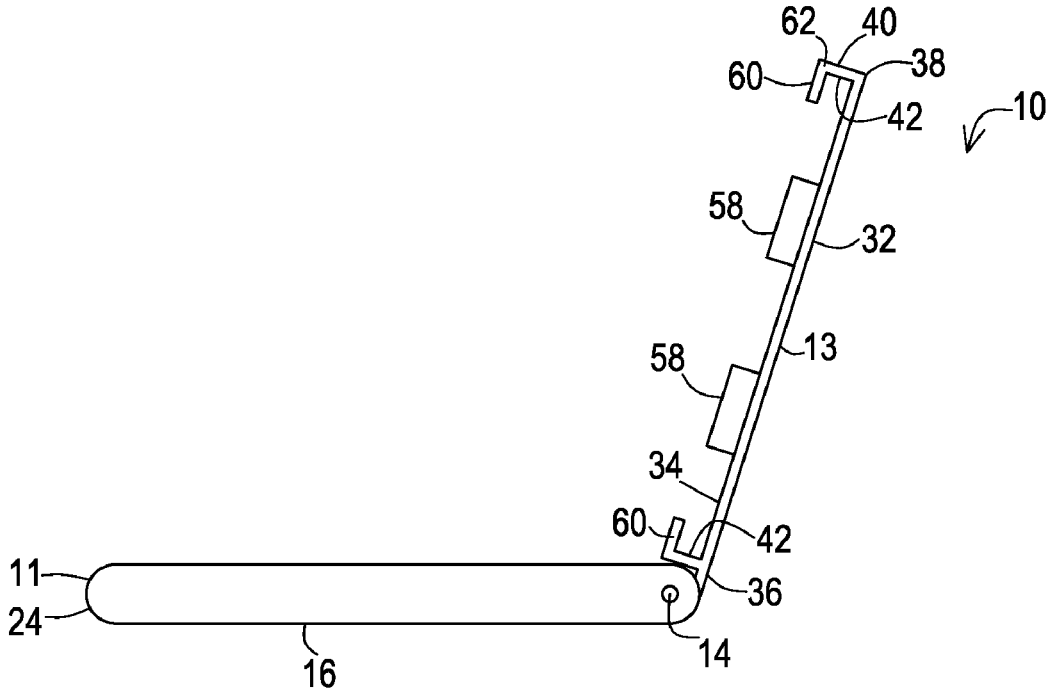
FIG. 7 depicts a side view of the exemplary protective covering shown in FIG. 6 with the fold-out prop member positioned within a recessed groove of the housing component.
Figure 8:
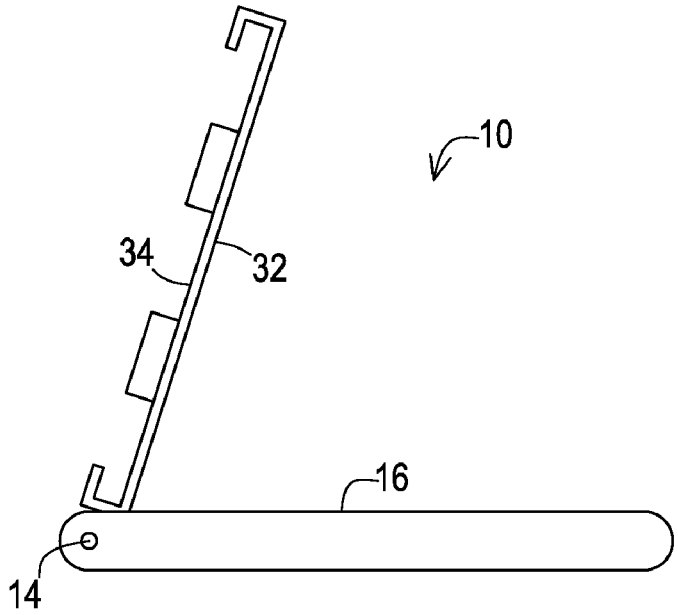
FIG. 8 depicts another side view of the exemplary protective covering shown in FIG. 6 with the fold-out prop member positioned within a recessed groove of the housing component.
Figure 9:
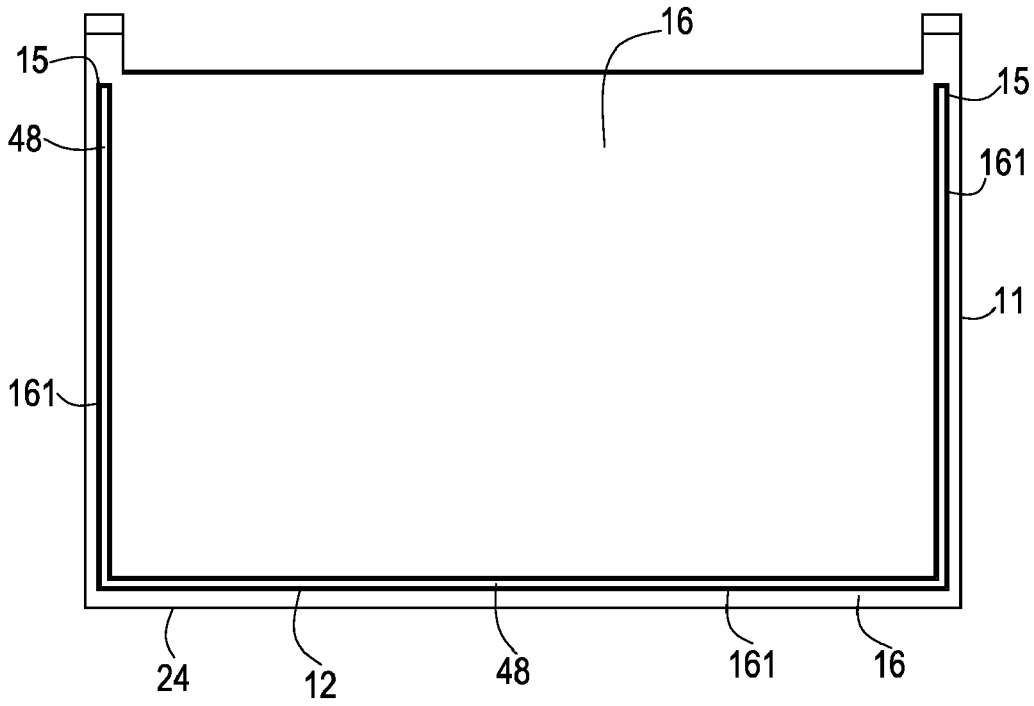
FIG. 9 depicts a bottom view of the exemplary protective covering shown in FIG. 6 showing a recessed groove within the exemplary housing component and an exemplary fold-out prop member positioned therein.
Figure 10A:
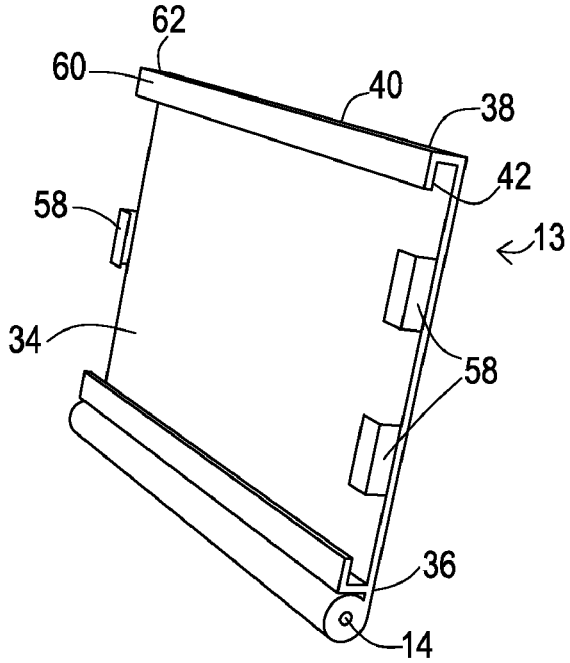
FIGS. 10A-10B depict front and rear views of the exemplary lid component of the exemplary protective covering shown in FIG. 6.
Figure 10B:
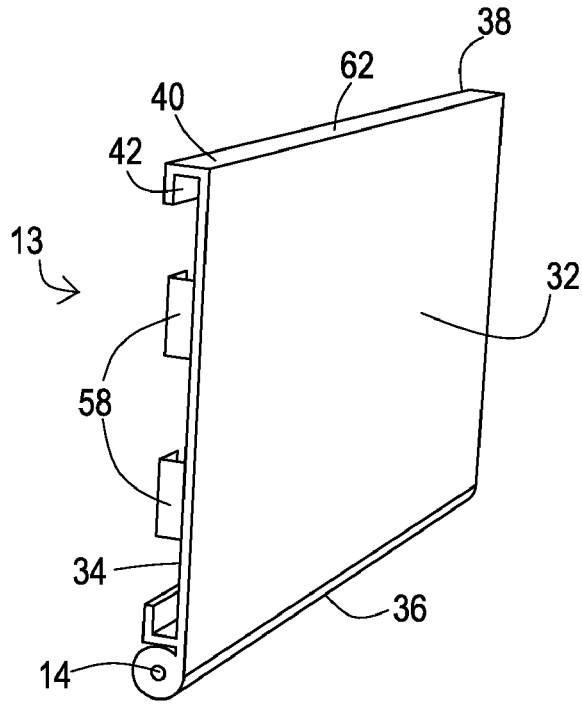
Figure 11:
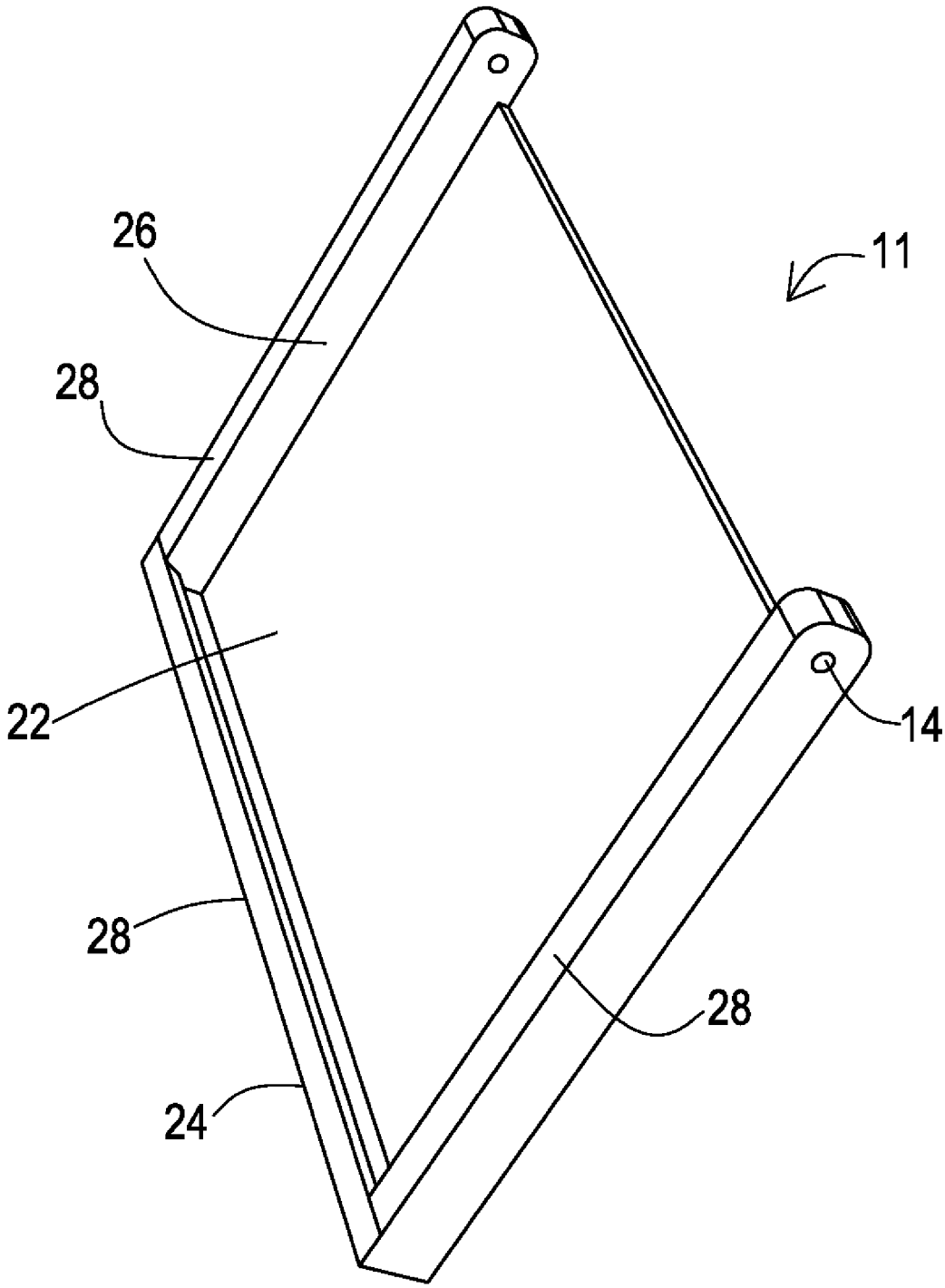
FIG. 11 depicts a side, top view of the exemplary housing component of the exemplary protective covering shown in FIG. 6.
Figure 12:
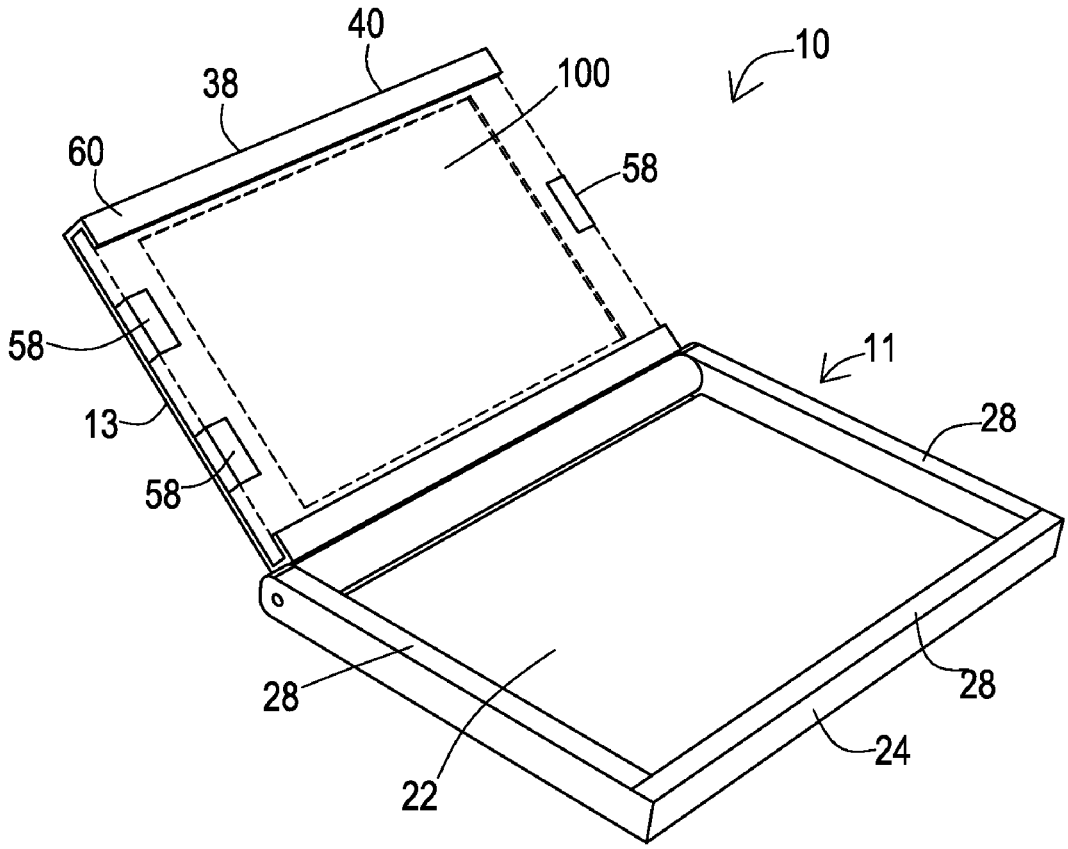
FIG. 12 provides a view of an exemplary protective covering in an opened, flat (i.e., non-tilted or non-propped) configuration and housing an exemplary electronic device.
Figure 13:
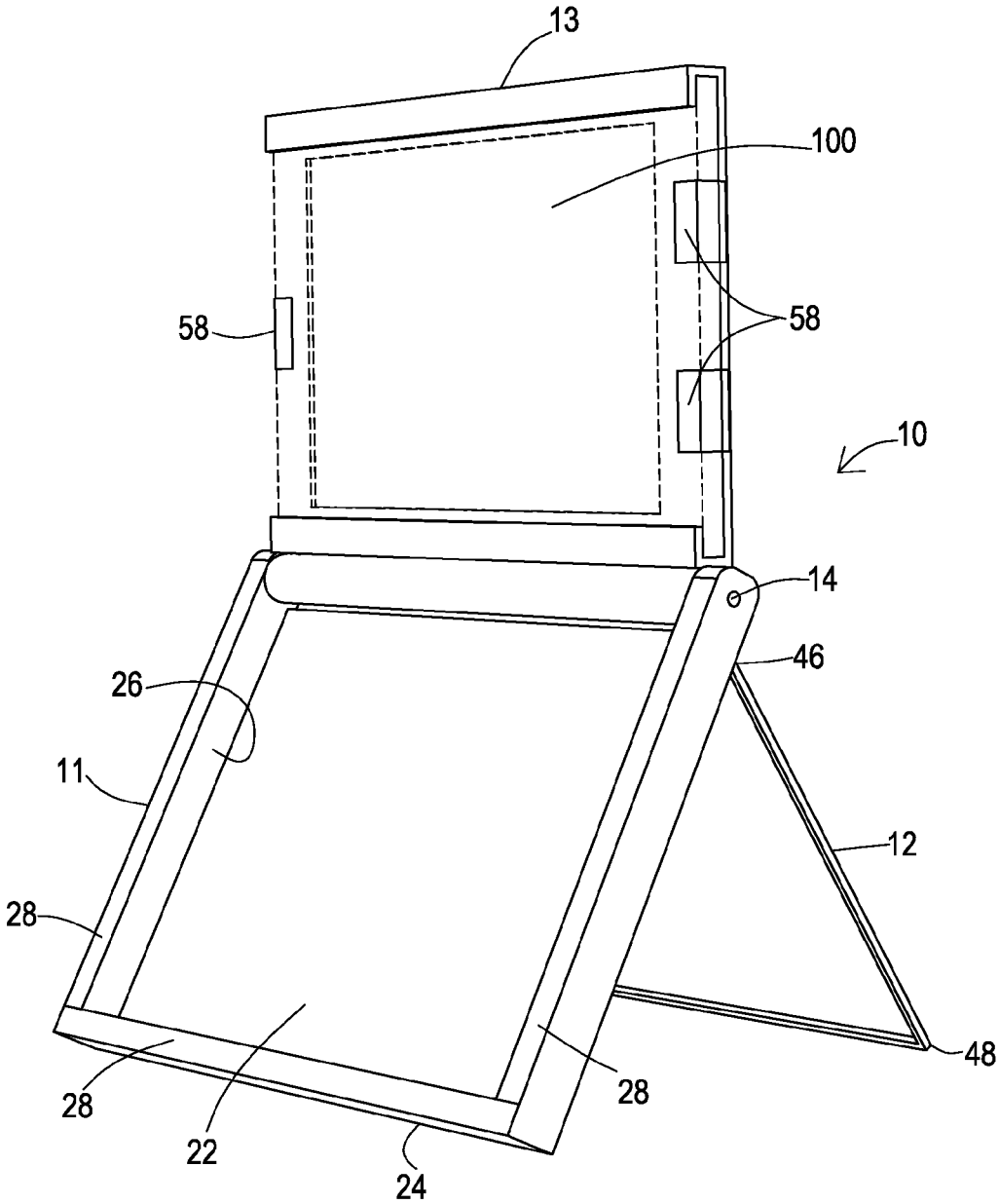
FIG. 13 provides a view of the exemplary protective covering shown in FIG. 12 in an opened, tilted or propped configuration and housing an exemplary electronic device.
Figure 14:
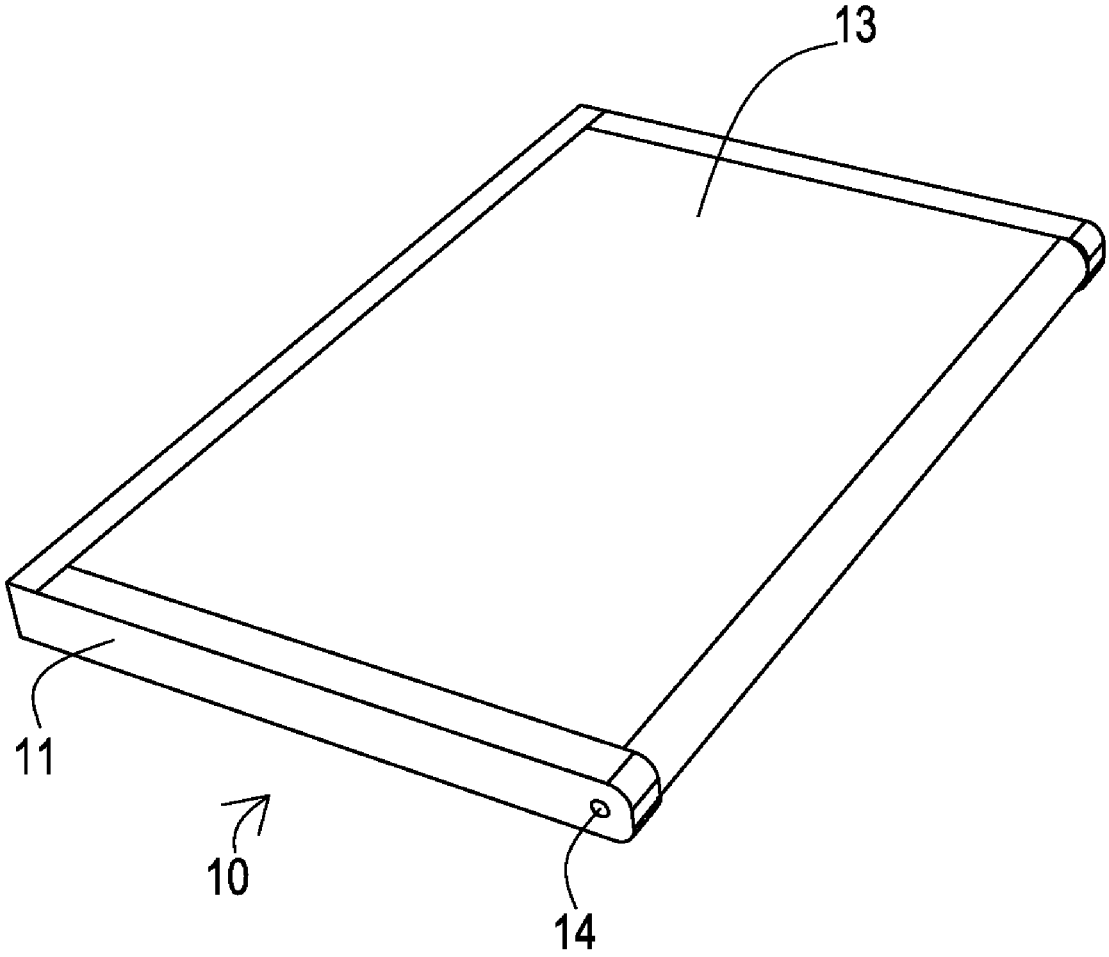
FIG. 14 provides a view of the exemplary protective covering shown in FIG. 12 in a closed configuration and housing an exemplary electronic device.
Figure 15:
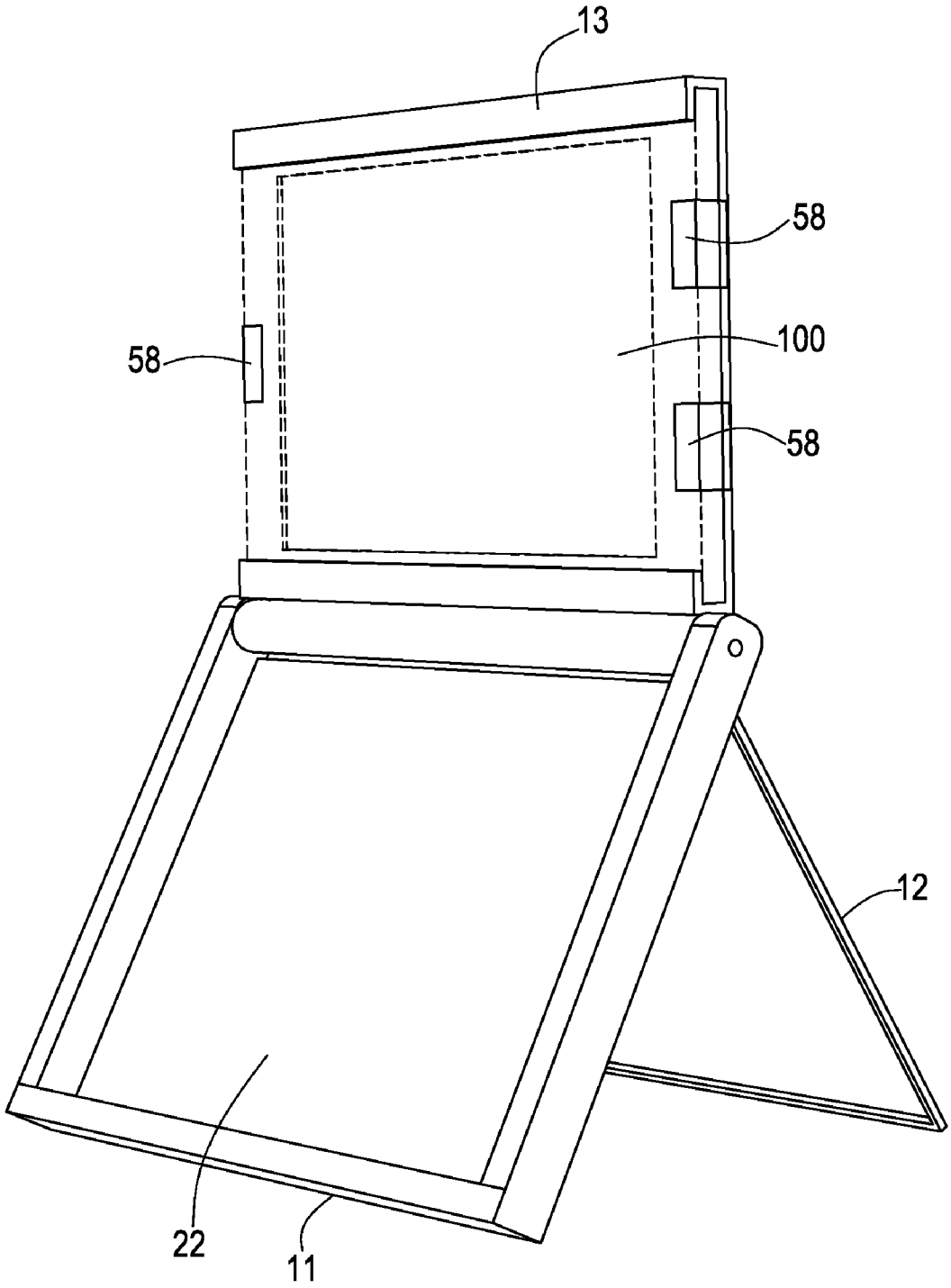
FIG. 15 provides a view of another exemplary protective covering in an opened, tilted or propped configuration and housing an exemplary electronic device.

In some exemplary embodiments, such as shown in FIGS. 6-9, housing component 11 further comprises a recessed groove 161 extending along rear housing surface 16 (see, FIG. 9). In these exemplary embodiments, a fold-out prop member, such as fold-out prop member 12, described below, is sized so as to fit within said recessed groove 161 when the fold-out prop member is in a first parallel position (discussed below). Typically, recessed groove 161 extends within at least a portion of at least one housing side wall 20.

In some exemplary embodiments, such as shown in FIGS. 6-15, exemplary housing component 11 has a rectangular shape, at least one housing side wall 20 extends along three sides of the rectangular shape, and recessed groove 161 extends within the at least one housing side wall 20 along the three sides of the rectangular shape.

In some exemplary embodiments, an upper surface of the at least one housing side wall 20 and an upper lid surface 32 (discussed below) together form an outermost surface of the protective covering when moveable lid end 38 is in a first closed position.

In some exemplary embodiments, exemplary housing component 11 further comprises a housing rim 28 (i) extending outward from an upper edge of at least a portion of the at least one side wall 20 and (ii) over and spaced from at least a portion of inner housing surface 22, housing rim 28 comprising an outer housing rim surface 50 and an inner housing rim surface 52 opposite outer housing rim surface 50. Outer housing rim surface 50 and upper lid surface 32 together may form an outermost surface of the protective covering when moveable lid end 38 is in a first closed position.

Exemplary housing component 11 may further comprise at least one opening therein (not shown), wherein the at least one opening is sized to enable one or more electrical cords, cables, or both to connect to an electronic device positioned along lid component 13 even when moveable lid end 38 is in a first closed position.

B. Lid Component

The devices of the present invention further comprise a lid component such as exemplary lid component 13 shown in FIGS. 1-5. The lid component serves three functions: (1) it holds an electronic device therein (see, for example, exemplary electronic device 100 positioned within exemplary lid component 13 shown in FIG. 4); (2) it positions the electronic device axially in space; and (3) it is used to close the protective covering into a conventional box-like configuration.

As shown in FIGS. 1-5, exemplary lid component 13 comprises an upper lid layer 30 comprising an upper lid surface 32, an inner lid surface 34 opposite upper lid surface 32, a connected lid end 36, and a moveable lid end 38 opposite connected lid end 36, and at least one lid side wall 62 extending from upper lid layer 30 and comprising an outer lid side wall surface 40, an inner lid side wall surface 42 opposite outer lid side wall surface 40, and a lid side wall portion 60 that extends over and is spaced from inner lid surface 34. Exemplary lid component 13 is connected to housing component 11 along connected lid end 36 so that moveable lid end 38 is operatively adapted to move from a first closed position, wherein inner lid surface 34 extends over inner housing surface 22, to a second open position, wherein substantially all of inner lid surface 34 does not extend over inner housing surface 22.

Figure 6:
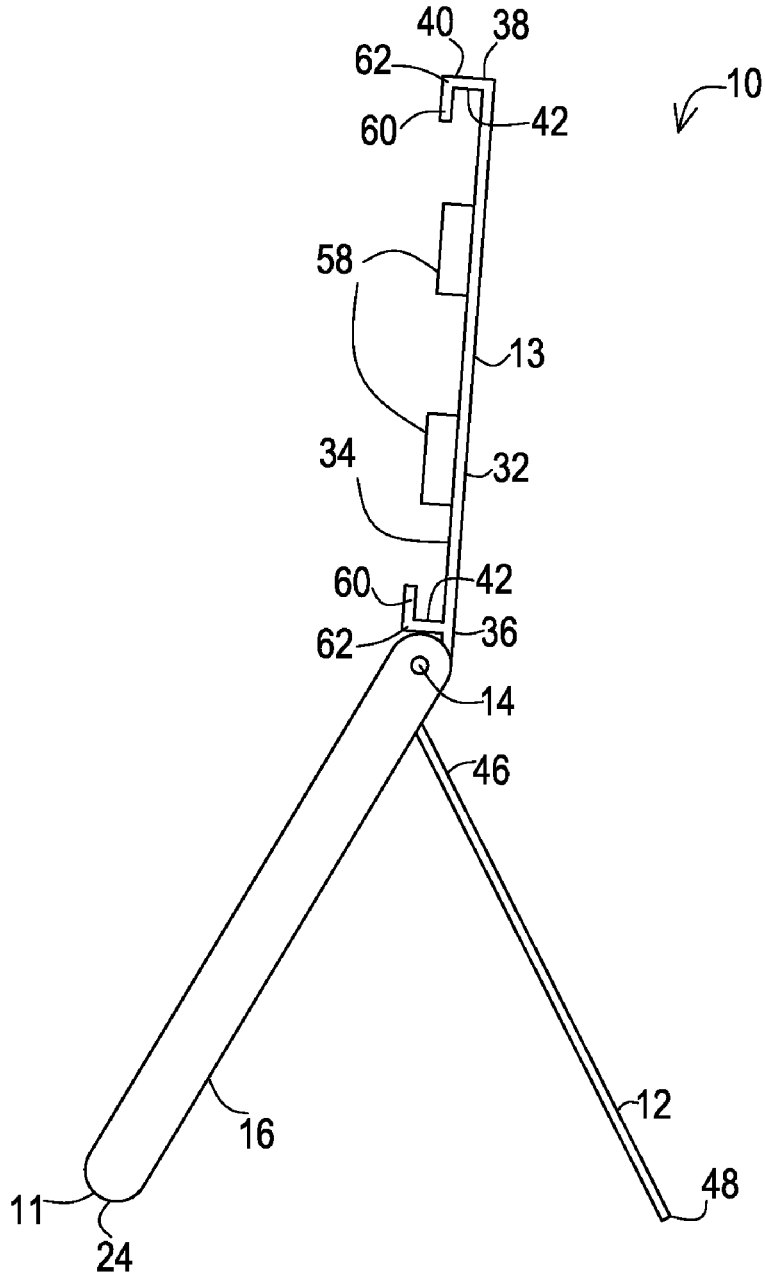
FIG. 6 depicts a side view of another exemplary protective covering of the present invention with the fold-out prop member in a supporting position.

Desirably, exemplary lid component 13 comprises a first lid side wall 62 extending from upper lid layer 30 proximate moveable lid end 38 and a second lid side wall 62 extending from upper lid layer 30 proximate connected lid end 36 as shown in FIGS. 6-8. In this exemplary embodiment, each of first and second lid side walls 62 comprises a lid side wall portion 60 that extends over and is spaced from inner lid surface 34 with first and second lid side walls 62 being spaced from one another so as to accommodate an electronic device positioned between first and second lid side walls 62.

Desirably, exemplary lid component 13 is operatively adapted to move from a first closed position (see, FIG. 1) to the second open position (see, FIG. 2) and to remain in any position therebetween unless a threshold amount of lid-opening force is applied to lid component 13.

Like exemplary housing component 11, exemplary lid component 13 may further comprise at least one opening therein (not shown), wherein the at least one opening is sized to enable one or more electrical cords, cables, or both to connect to an electronic device positioned along lid component 13 even when moveable lid end 38 is in a first closed position (see, FIG. 1).

As shown in the figures, exemplary lid component 13 may further comprise one or more optional stop members 58 positioned on one or both opposite sides of exemplary lid component 13, extending from upper lid layer 30. In this exemplary embodiment, one or more optional stop members 58 may be used to further secure an electronic device in place along inner lid surface 34. See, for example, FIGS. 5-8 and 10A-10B.

C. Fold-Out Prop Member

The devices of the present invention may further comprise a fold-out prop member component such as exemplary support member 12 shown in FIGS. 1-5. The fold-out prop member can be deployed for use, or retracted into a groove within the housing component when not in use.

As shown in the figures, exemplary fold-out prop member 12 comprises a connected fold-out prop member end 46, and a moveable fold-out prop member end 48 opposite connected fold-out prop member end 46. Connected fold-out prop member end 46 is connected to rear housing surface 16 so that moveable fold-out prop member end 48 is operatively adapted to move from a first parallel position, wherein moveable fold-out prop member end 48 extends along and is proximate to rear housing surface 16, to a second angled position, wherein moveable fold-out prop member end 48 is positioned away from rear housing surface 16.

Desirably, fold-out prop member 12 is operatively adapted to remain in a first parallel position or a second angled position unless a threshold amount of force is applied to fold-out prop member 12.

II. Methods of Making Protective Coverings

The present invention is also directed to methods of making protective coverings. In one exemplary embodiment of the present invention, the method of making a protective covering comprises the step of forming at least one molded part comprising (i) the housing component, (ii) the fold-out prop member, and (iii) the lid component; and connecting (i) the housing component, (ii) the fold-out prop member, and (iii) the lid component. The method of making a protective covering may further comprise one or more additional steps including, but not limited to, printing and/or adhering an image onto an outer surface of the at least one molded part; and packaging the protective covering.

Typically, each of the components of the protective coverings of the present invention is formed via one or more thermoforming steps (e.g., one or more injection molding step). Each of the components of the protective coverings may be formed from any desired material. Typically, each of the components of the protective coverings comprises a thermoformable material such as a polymeric material. Suitable polymeric materials for forming each of the components of the protective coverings include, but are not limited to, a polyolefin (e.g., polyethylene, polypropylene, copolymers of ethylene and propylene), a polyester (e.g., PET), polyvinyl chloride, a polyacrylate (e.g., polymethyl methacrylate), or any other thermoformable polymer. Although polymeric material is typically used to form each of the components of the protective coverings, other suitable materials for forming each of the components of the protective coverings include, but are not limited to, a metallic material (e.g., aluminum), a cellulosic material (e.g., wood), and a ceramic material.

III. Methods of Using Protective Coverings

The present invention is even further directed to methods of using the above-described protective coverings. In one exemplary embodiment of the present invention, the method comprises a method of positioning a computer/electronic device in three-dimensional space so that it is optimal for human use, whether the human be sitting, slouching, partially reclined, or fully reclined. The articulating nature of the disclosed protective coverings allows the protective covering to place a reading or viewing surface so that human neck strain and arm fatigue is minimized. Furthermore, the reading or viewing surface can be rotated into a plane that is perpendicular to the human's line of sight to optimize the visual experience.

The present invention is further directed to methods of using a protective covering to protect and house an electronic device. In one exemplary embodiment of the present invention, the method of using a protective covering comprises a method of covering an electronic device, wherein the method comprises positioning the electronic device along an inner surface of the lid component; and closing the protective covering so as to protect and house the electronic device within the housing component.

In another exemplary embodiment, the method of using a protective covering comprises opening a protective covering having an electronic device positioned therein; withdrawing a fold-out prop member from a first position adjacent a lower surface of the housing component; and adjusting a height of the electronic device by adjusting (i) a position of the fold-out prop member relative to the housing component, (ii) a position of the lid component relative to the housing component, or (iii) both (i) and (ii).

The present invention is described above and further illustrated below by way of examples, which are not to be construed in any way as imposing limitations upon the scope of the invention. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLE 1

Preparation of a Protective Covering

Exemplary protective coverings as shown in FIGS. 1-15 were prepared using conventional steps (e.g., one or more thermoforming steps, and one or more connection steps).

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A protective covering for protecting and housing an electronic device, said protective covering comprising:

a housing component comprising:

a lower housing layer comprising a rear housing surface and an inner housing surface opposite said rear housing surface, at least one housing side wall extending upward from said lower housing layer and comprising an outer housing side wall surface and an inner housing side wall surface opposite said outer housing side wall surface, and at least one housing connection member along said inner housing side wall surface;

a lid component comprising:

an upper lid layer comprising an upper lid surface, an inner lid surface opposite said upper lid surface, a connected lid end, and a moveable lid end opposite said connected lid end, and at least one lid side wall extending from said upper lid layer and comprising an outer lid side wall surface, an inner lid side wall surface opposite said outer lid side wall surface, and a lid side wall portion that extends over and is spaced from said inner lid surface;

said lid component being connected to said housing component along said connected lid end so that said moveable lid end is operatively adapted to move from a first closed position, wherein said inner lid surface extends over said inner housing surface, to a second open position, wherein substantially all of said inner lid surface does not extend over said inner housing surface, and a fold-out prop member comprising a connected fold-out prop member end, and a moveable fold-out prop member end opposite said connected fold-out prop member end, said connected fold-out prop member end being connected to said housing component so that said moveable fold-out prop member end is operatively adapted to move from a first parallel position, wherein said moveable fold-out prop member end extends along and is proximate to said rear housing surface, to a second angled position, wherein said moveable fold-out prop member end is positioned away from said rear housing surface.

2. The protective covering of claim 1, wherein said housing component further comprises a recessed groove extending along said rear housing surface, and said fold-out prop member is sized so as to fit within said recessed groove when said fold-out prop member is in the first parallel position.

3. The protective covering of claim 2, wherein said recessed groove extends within at least a portion of said at least one housing side wall.

4. The protective covering of claim 3, wherein said housing component has a rectangular shape, said at least one housing side wall extends along three sides of the rectangular shape, and said recessed groove extends within said at least one housing side wall along the three sides of the rectangular shape.

5. The protective covering of claim 1, wherein said fold-out prop member is operatively adapted to remain in said first parallel position or said second angled position unless a threshold amount of force is applied to said fold-out prop member.

6. The protective covering of claim 1, wherein an upper surface of said at least one housing side wall and said upper lid surface together form an outermost surface of said protective covering when said moveable lid end is in the first closed position.

7. The protective covering of claim 1, wherein said housing component further comprises:

a housing rim (i) extending outward from an upper edge of at least a portion of said at least one side wall and (ii) over and spaced from at least a portion of said inner housing surface, said housing rim comprising an outer housing rim surface and an inner housing rim surface opposite said outer housing rim surface;

wherein said outer housing rim surface and said upper lid surface together form an outermost surface of said protective covering when said moveable lid end is in the first closed position.

8. The protective covering of claim 3, wherein said lid component comprises a first lid side wall extending from said upper lid layer proximate said moveable lid end and a second lid side wall extending from said upper lid layer proximate said connected lid end, each of said first and second lid side walls comprising a lid side wall portion that extends over and is spaced from said inner lid surface, said first and second lid side walls being spaced from one another so as to accommodate an electronic device positioned between said first and second lid side walls.

9. The protective covering of claim 1, wherein said lid component is operatively adapted to move from the first closed position to the second open position and to remain in any position therebetween unless a threshold amount of lid-opening force is applied to said lid component.

10. The protective covering of claim 1, wherein said housing component or said lid component further comprises at least one opening therein, said at least one opening being sized to enable one or more electrical cords, cables, or both to connect to an electronic device positioned along said or said lid component even when said moveable lid end is in the first closed position.

11. The protective covering of claim 1 in combination with an electronic device, said protective covering and said electronic device being sized so that said electronic device can be secured to said lid component and positioned within said housing component when said moveable lid end is in the first closed position.

12. A protective covering for protecting and housing an electronic device, said protective covering comprising:

a housing component comprising:

a lower housing layer comprising a rear housing surface and an inner housing surface opposite said rear housing surface, at least one housing side wall extending upward from said lower housing layer and comprising an outer housing side wall surface and an inner housing side wall surface opposite said outer housing side wall surface, and at least one housing connection member along said inner housing side wall surface;

a lid component comprising:

an upper lid layer comprising an upper lid surface, an inner lid surface opposite said upper lid surface, a connected lid end, and a moveable lid end opposite said connected lid end, and at least one lid side wall extending from said upper lid layer and comprising an outer lid side wall surface, an inner lid side wall surface opposite said outer lid side wall surface, and a lid side wall portion that extends over and is spaced from said inner lid surface; and a fold-out prop member comprising a connected fold-out prop member end, and a moveable fold-out prop member end opposite said connected fold-out prop member end, said connected fold-out prop member end being connected to said rear housing surface so that said moveable fold-out prop member end is operatively adapted to move from a first parallel position, wherein said moveable fold-out prop member end extends along and is proximate to said rear housing surface, to a second angled position, wherein said moveable fold-out prop member end is positioned away from said rear housing surface;

said lid component being connected to said housing component along said connected lid end so that said moveable lid end is operatively adapted to move from a first closed position, wherein said inner lid surface extends over said inner housing surface, to a second open position, wherein substantially all of said inner lid surface does not extend over said inner housing surface;

wherein said housing component further comprises a recessed groove extending along said rear housing surface, and said fold-out prop member is sized so as to fit within said recessed groove when said fold-out prop member is in the first parallel position.

13. The protective covering of claim 12, wherein said lid component comprises a first lid side wall extending from said upper lid layer proximate said moveable lid end and a second lid side wall extending from said upper lid layer proximate said connected lid end, each of said first and second lid side walls comprising a lid side wall portion that extends over and is spaced from said inner lid surface, said first and second lid side walls being spaced from one another so as to accommodate an electronic device positioned between said first and second lid side walls.

14. The protective covering of claim 12, wherein said housing component or said lid component further comprises at least one opening therein, said at least one opening being sized to enable one or more electrical cords, cables, or both to connect to an electronic device positioned along said or said lid component even when said moveable lid end is in the first closed position.

15. The protective covering of claim 12 in combination with an electronic device, said protective covering and said electronic device being sized so that said electronic device can be secured to said lid component and positioned within said housing component when said moveable lid end is in the first closed position.

16. A protective covering for protecting and housing an electronic device, said protective covering comprising:

a housing component comprising:

a lower housing layer comprising a rear housing surface and an inner housing surface opposite said rear housing surface, at least one housing side wall extending upward from said lower housing layer and comprising an outer housing side wall surface and an inner housing side wall surface opposite said outer housing side wall surface, and at least one housing connection member along said inner housing side wall surface;

a lid component comprising:

an upper lid layer comprising an upper lid surface, an inner lid surface opposite said upper lid surface, a connected lid end, and a moveable lid end opposite said connected lid end, and a first lid side wall extending from said upper lid layer proximate said moveable lid end and a second lid side wall extending from said upper lid layer proximate said connected lid end, each of said first and second lid side walls comprising a lid side wall portion that extends over and is spaced from said inner lid surface, said first and second lid side walls being spaced from one another so as to accommodate an electronic device positioned between said first and second lid side walls; and a fold-out prop member comprising a connected fold-out prop member end, and a moveable fold-out prop member end opposite said connected fold-out prop member end, said connected fold-out prop member end being connected to said rear housing surface so that said moveable fold-out prop member end is operatively adapted to move from a first parallel position, wherein said moveable fold-out prop member end extends along and is proximate to said rear housing surface, to a second angled position, wherein said moveable fold-out prop member end is positioned away from said rear housing surface;

said lid component being connected to said housing component along said connected lid end so that said moveable lid end is operatively adapted to move from a first closed position, wherein said inner lid surface extends over said inner housing surface, to a second open position, wherein substantially all of said inner lid surface does not extend over said inner housing surface;

wherein said housing component further comprises a recessed groove extending along said rear housing surface, and said fold-out prop member is sized so as to fit within said recessed groove when said fold-out prop member is in the first parallel position.

17. The protective covering of claim 16, wherein (I) said fold-out prop member is operatively adapted to remain in said first parallel position or said second angled position unless a threshold amount of force is applied to said fold-out prop member, and (II) said lid component is operatively adapted to move from the first closed position to the second open position and to remain in any position therebetween unless a threshold amount of lid-opening force is applied to said lid component.

18. The protective covering of claim 17, wherein said housing component has a rectangular shape, said at least one housing side wall extends along three sides of the rectangular shape, and said recessed groove extends within said at least one housing side wall along the three sides of the rectangular shape.

19. The protective covering of claim 18 in combination with an electronic device, said protective covering and said electronic device being sized so that said electronic device can be secured to said lid component and positioned within said housing component when said moveable lid end is in the first closed position.

* * * * *